US005713331A

United States Patent [19]

Eisenbacher et al.

[11] Patent Number: 5,713,331

[45] Date of Patent: Feb. 3, 1998

[54] INJECTION AND EXHAUST-BRAKE SYSTEM FOR AN INTERNAL COMBUSTION ENGINE HAVING SEVERAL CYLINDERS

[75] Inventors: Egon Eisenbacher, Karlstadt/Main; Manfred Unger, Kleinostheim, both of Germany

[73] Assignee: Mannesmann Rexroth GmbH, Lohr/Main, Germany

[21] Appl. No.: 579,040

[22] Filed: Dec. 19, 1995

[30] Foreign Application Priority Data

Dec. 21, 1994 [DE] Germany ..... 44 45 641.7
Oct. 31, 1995 [DE] Germany ..... 195 40 549.8

[51] Int. Cl.[6] ..... F02D 37/00

[52] U.S. Cl. ..... 123/322; 123/324

[58] Field of Search ..... 123/321, 322, 123/324

[56] References Cited

U.S. PATENT DOCUMENTS

| | | | |
|---|---|---|---|
| 3,220,392 | 11/1965 | Cummins | 123/321 |
| 5,000,146 | 3/1991 | Szucsanyi | 123/321 |
| 5,564,386 | 10/1996 | Korte et al. | 123/321 |

FOREIGN PATENT DOCUMENTS

| | | |
|---|---|---|
| 0299337 | 1/1989 | European Pat. Off. . |
| 0383088 | 8/1990 | European Pat. Off. . |
| 3618447 | 12/1987 | Germany . |
| 3904497 | 1/1990 | Germany . |
| 4007287 | 9/1991 | Germany . |
| 4121884 | 1/1992 | Germany . |
| 4121435 | 1/1993 | Germany . |
| 4226970 | 2/1993 | Germany . |
| 4301835 | 11/1993 | Germany . |

OTHER PUBLICATIONS

Schneider, Wolfgang, u.a.: Hochdruckeinspritzung und Abgasrezirkulation im kleinen, schhnellaufenden Dieselmotor mit direkter Einspritzung. In: MTZ Motortechnische Zeitschrift 54, 1993, S.588–599.

Schwarz, Helmut, u.a.: Steuerung der Einspritzung und Zündung von Ottomotoren mit Hilfe der digitalen Motorelektronik Motronic. In: Bosch Techn. Berichte 7, 1981, 3, S. 139–151.

*Primary Examiner*—Andrew M. Dolinar
*Attorney, Agent, or Firm*—Martin A. Farber

[57] ABSTRACT

An injection system for an internal combustion engine having a plurality of cylinders is known which has a hydraulic pump with a delivery outlet to which a delivery line common to the cylinders is connected, and a plurality of injection units each of which is associated with a different cylinder and, in normal drive operation, can be controlled pulsewise by connection with the delivery line. There is also known an exhaust-brake system having a plurality of decompression valves each of which is associated with a different cylinder and, in brake operation, can be controlled pulsewise outside the exhaust stroke, in particular at the end of the compression stroke, by alternate pressure action on and pressure relief of the hydraulic actuating element. The purpose is to create a system with which, at little expense and at favorable cost, the "injection" and "exhaust-brake" functions can be satisfied. This is achieved by a plurality of valve arrangements, each of which is associated with a different cylinder and in normal drive operation connects the injection unit and the in brake operation the hydraulic actuating element on the corresponding cylinder, with proper timing, to the delivery line.

11 Claims, 5 Drawing Sheets

INJECTION AND EXHAUST-BRAKE SYSTEM FOR AN INTERNAL COMBUSTION ENGINE HAVING SEVERAL CYLINDERS

FIELD AND BACKGROUND OF THE INVENTION

The present invention proceeds from an injection and exhaust-brake system intended for an internal combustion engine having several cylinders, which has the features set forth in the preamble to Claim 1.

From EP 0 299 337 A2 an injection system for an internal combustion engine which is known as a "common-rail system" is known. Such an injection system is characterized by the fact that a hydraulic pump has a single delivery outlet to which a delivery line leading to all cylinders of the internal combustion engine is connected. Each injection nozzle has, associated with it, a solenoid valve the outlet of which on the injection-nozzle side can be connected to the delivery line. Whenever this connection is established, the injection nozzle is stepped up. In accordance with the injection system known from EP 0 299 337 A2 and, therefore, in a system in accordance with the preamble to Claim 1, there are present a hydraulic pump having a delivery outlet to which a delivery line common to the cylinders of the internal combustion engine is connected, and several injection nozzles, each of which can be controlled pulsewise in normal drive operation by actuation of a servo-valve, which has an outlet on the injection-nozzle side which is connected in a first position of the valve with a relief line and in a second position of the valve with the delivery line.

From Federal Republic of Germany 41 21 435 A1, a exhaust-brake system for an internal combustion engine having several cylinders is known in which a central hydraulic pump developed as positive displacement pump is associated with the individual decompression valves seated on the cylinders, the individual displacement elements of which pump convey pressure fluid from a low-pressure region into a high-pressure region of the pump housing. There is integrated in the pump a distributor device from which a number of control lines corresponding to the number of cylinders of the internal combustion engine extend, each of which control lines leads to an actuating element of a decompression valve and each of which can be connected via the distributor device with the high-pressure region of the pump housing and, for the opening of the decompression valve and with the low-pressure region of the pump housing for the closing of the decompression valve. An internal combustion engine which is provided with an injection system of the common-rail type in accordance with EP 0 299 337 A2 can readily also have a, exhaust-brake system in accordance with Federal Republic of Germany 41 21 435 A1. The mere addition of the known injection system and of the known exhaust-brake system, however, results in a relatively high expense.

From EP 0 383 088 A1 it is known to combine an injection system and an exhaust-brake system into a single system in the manner that, in the system, the fuel for the internal combustion engine is used as pressure fluid and a single source of pressure is used in normal drive operation in order to convey fuel to an injection nozzle of the cylinder and, in brake operation, to apply pressure to the actuating element for a decompression valve of this cylinder. For this purpose, the outlet of the source of pressure is connected via a valve in normal drive operation with the injection nozzle and in brake operation with the actuating element. The injection-part system in accordance with EP 0 383 088 A1 is not a common-rail system but an in-line injection pump system in which a displacement piston of the in-line injection pump is associated with each cylinder of the internal combustion engine. This one displacement piston forms the source of pressure for the conveying of the pressure fluid to the injection nozzle of a cylinder and for the action of the pressure fluid on the actuating element on the same cylinder. Accordingly, therefore, in an in-line injection pump system, a number of sources of pressure corresponding to the number of cylinders are present, while in a common-rail system one source of pressure is associated with several cylinders, and preferably all cylinders, of the internal combustion engine.

SUMMARY OF THE INVENTION

The object of the invention is to expand a common-rail injection system on an internal combustion engine having several cylinders in an inexpensive manner to a system which performs the injection function and the exhaust-brake function.

This object is achieved in accordance with the invention by an injection and exhaust-brake system of the introductorily-mentioned type, further wherein and in which, in accordance with the body of Claim 1, several valve arrangements are present, each of which is associated with a different cylinder, and in normal drive operation connects the injection unit, and in brake operation the hydraulic actuating element on the cylinder in question to the delivery line, with proper timing. Therefore, a hydraulic pump and a delivery line are common for the functions injection and exhaust-brake, so that the expense and the cost thereof for the entire system are rather low.

Further advantageous developments of an injection and exhaust-brake system in accordance with the invention can be noted from the following.

Thus, in accordance with Claim 2, a valve arrangement corresponding to a cylinder comprises a first servo-valve which controls the connection of the injection unit of the cylinder with the delivery line, and a second servo-valve which controls the connection of the actuating element for the decompression valve of the cylinder with the delivery line. Via the valve arrangement, the hydraulic actuating element of a decompression valve can, in accordance with Claim 3, be connected with proper timing alternately with the delivery line and with a relief line.

The valve arrangement becomes simpler if, in accordance with Claim 4, an actuating element is in each case connected only with the delivery line or separated from it and the relief of the actuating element takes place via a throttle. It may be that the decompression valve then closes somewhat slower than upon relief of the actuating element via a directional control valve. The slower closing, however, does not result in any disadvantages.

In principle, it is conceivable for a servo-valve by the actuating of which the injection nozzle of a cylinder can be controlled and a servo-valve via which the actuating element of the decompression valve of this cylinder can be acted on by pressure, to be combined to form a single servo-valve with a single control member, the control member being displaced both upon a valve actuation for the control of the injection nozzle and upon a valve actuation for the action of pressure on the actuating element. To be sure, in that case a relatively large mass must be accelerated upon each actuation. It therefore appears more favorable if, in accordance with Claim 5, the first servo-valve and the second servo-valve, which are associated with the same cylinder, are two separate directional control valves with separate individually actuatable control members. The two separate control members then are of relatively less weight so that the valves can be switched very rapidly. In this connection, the two servo-valves of a cylinder may definitely have a common housing block.

One particularly preferred further development of an injection and exhaust-brake system in accordance with the invention consists, in accordance with Claim 6, therein that, depending on whether normal drive operation or brake operation is present, the injection unit or the actuating element of a cylinder is connected by means of a selection valve to the same pulsewise controllable servo-valve and is connected via the servo-valve alternately with the delivery and the relief lines. The selection valve remains in its instantaneous position as long as driving in normal drive operation or in brake operation. Only upon a change between drive operation and brake operation does it switch. The servo-valve switches corresponding to the necessary pulsewise control of the injection unit or of the actuating element with a frequency which is dependent of the speed of rotation of the internal combustion engine, unless push operation prevails, during which the servo-valve can remain in a position of rest, neither fuel is injected nor the decompression valve opened, and only the normal brake action of the internal combustion engine is present.

Thus, with a development in accordance with Claim 6, only a single pulsewise-switching servo-valve per cylinder of the internal combustion engine is necessary and the control expense for the actuating of the servo-valves is reduced as compared with the solution having two servo-valves to be controlled pulsewise per cylinder.

In accordance with Claim 7, in normal drive operation, the actuating element and in brake operation the injection unit is relieved to the relief line via the selection valve.

Since the period of time during which fuel is injected in each case through the same nozzle or during which in each case the same decompression valve is open is shorter than the intervening time span, it is advantageous for the position which a servo-valve assumes in the intervening time span during which injection unit or actuating element are relieved from pressure to be a position of rest which is brought about the force of a spring element.

In the particularly simple embodiment in accordance with Claim 9, the pressure fluid conveyed by the high-pressure pump is the fuel for the internal combustion engine and injection valves included in the injection units can be connected pulsewise via servo-valves with the delivery line.

In accordance with Claim 10, an injection unit comprises an injection nozzle and a pressure booster arranged upstream of the injection nozzle, fuel can be conveyed by a fuel pump to the secondary side of the pressure booster, and in normal drive operation, the primary sides of the pressure booster and in brake operation the actuating elements of the decompression valves can be acted on by pressure. In this way, the pressure in the common delivery line can be limited to a lower level, which is necessary for the opening of the decompression valves and which can lie approximately in the region of 100 bar. Also in a system according to Claim 10, it is possible for the fuel conveyed by the fuel pump to be used to act on the actuating elements of the decompression valves and furthermore also to act on the primary side of the pressure boosters.

However, as indicated in Claim 11, in addition to the fuel pump, a further hydraulic pump may be present to the delivery outlet of which the delivery line to which the servo-valves are attached is connected. The pressure fluid conveyed by the further hydraulic pump into the common delivery line is then preferably the lubricating oil of the internal combustion engine.

The servo-valves are preferably actuated by electromagnets, since in this way rapid switch times can be obtained.

In particular, when the injection nozzles are supplied with fuel via the common delivery line, the result can be obtained, with the aid of an adjustable valve, and in particular with the aid of an adjustable pressure-limiting valve, that in normal drive operation, when fuel is to be injected, a higher pressure prevails in the common delivery line than upon brake operation. The valve can also be used in order to vary the pressure in the delivery line in brake operation itself. It has namely been found that the brake action is dependent also on the pressure in the delivery line.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
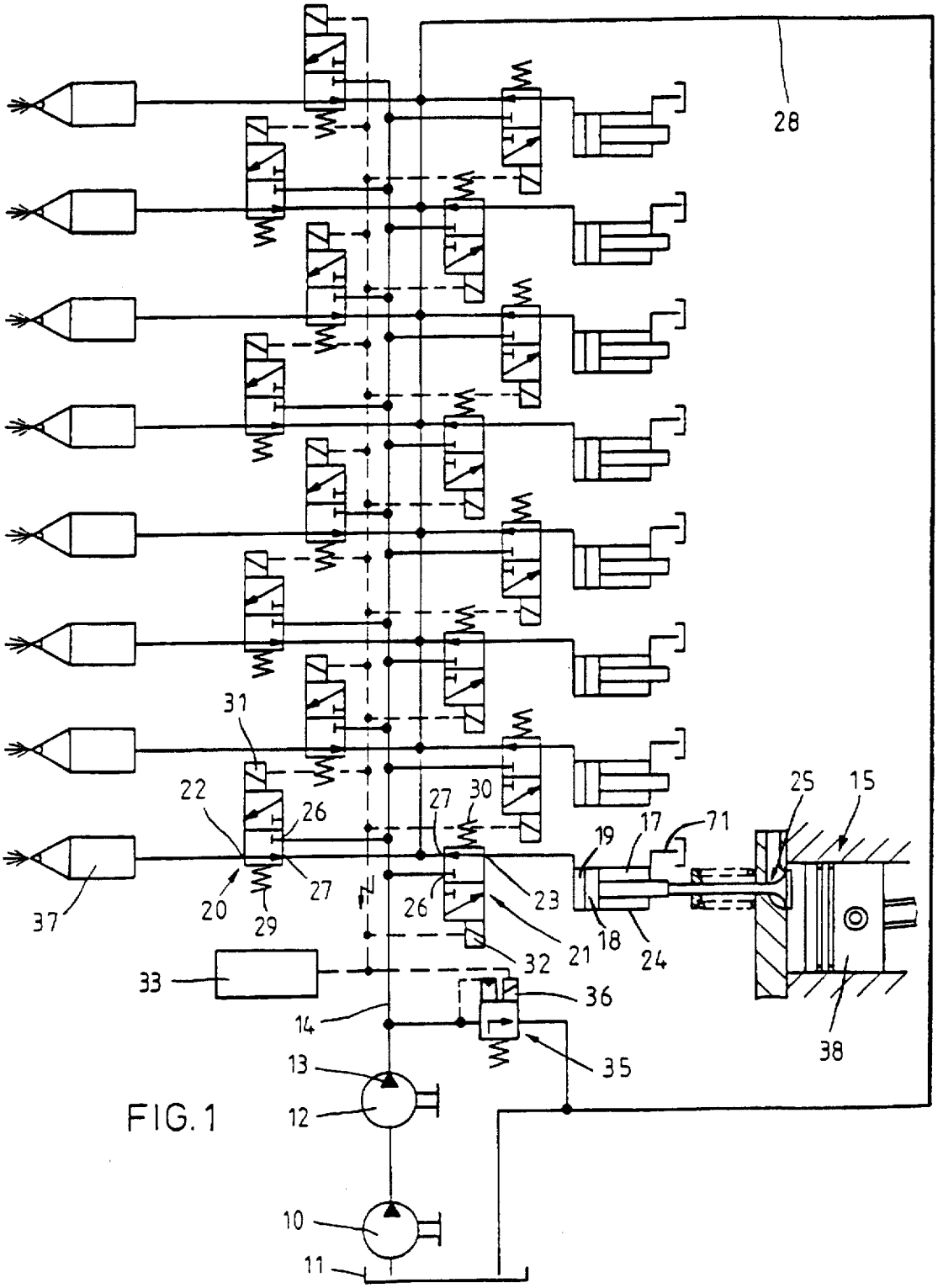
FIG. 1 shows a first embodiment in which fuel is fed to the injection nozzles directly from the common delivery line of the system, two pulsewise actuated servo-valves per cylinder of the internal combustion engine being present.

In the embodiment of FIG. 1, a predelivery pump 10, which can preferably be driven by an electric motor, not shown in detail, draws diesel fuel from a tank 11 and conveys it to the inlet of a high-pressure pump 12 which is ordinarily driven by the internal combustion engine on which the injection and exhaust-brake system shown is arranged. The high-pressure pump 12 has a single delivery outlet 13 to which a single delivery line 14 is connected, it leading from the high-pressure pump 12 to all cylinders 15 of the internal combustion engine. For the sake of clarity, only one of the total of eight cylinders present in the present example is shown.

With each cylinder 15 there are functionally associated two servo-valves 20 and 21 developed as 3/2 distribution valves, they being preferably seated directly on the corresponding cylinder 15. The servo-valve 20 has an outlet 22 from which a line leads to an injection nozzle 37 of the cylinder 15 in question. Each servo-valve 21 has an outlet 23 which is connected with a pressure space 19, adjoining a movable piston 18, of an actuating element 24, developed as hydraulic cylinder, for a decompression valve 25 of the corresponding cylinder 15. Each servo-valve 20 and 21 furthermore has an inlet 26 which is connected to the common delivery line 14, and an outlet 27 which is connected to a return line 28 which leads back to the tank 11. An annular space 17 of each actuating element 24 is connected to the tank via a leakage line 71.

In their position of rest which the valves 20 and 21 assume under the action of compression springs 29 and 30 respectively, the outlet 22 on the injection-nozzle side of the servo-valves 20 and the outlet 23 on the actuating-element side of the servo-valves 21 is connected with the outlet 27, and thus with the return line 28. The inlet 26 is blocked. The servo-valves can be displaced by an electromagnet 31 and 32 respectively from the position of rest into a second switch position in which the outlet 27 is blocked and the outlet 22 or 23 is connected with the inlet 26 and therefore with the delivery line 14. The electromagnets are controlled by an electronic unit 33 via electric lines which are shown in dashed line in the figure. One dashed line can, in this connection, stand for several electrical lines.

As decompression valve 25, the ordinary outlet valve of a cylinder 15 can be used. However, a decompression valve can also be provided in addition to the normal inlet and outlet valves of a cylinder.

In operation, the high-pressure pump 12, which is preferably a radial piston pump having several radial pistons, conveys fuel into the delivery line 14 in which, due to the plurality of radial pistons of the pump 12 and the storage capacity of the delivery line, an at least approximately constant pressure level is established. By means of a pressure-limiting valve, which is adjustable proportionally by an electromagnet which can also be controlled by the electronic unit 33, the pressure level in the delivery line 14 can be changed. In normal drive operation, the servo-valves 20 connect the injection nozzles 23 with the delivery line 14 in accordance with the firing order of the internal combustion engine. In this connection, the servo-valves 20 are brought by the electromagnets 31 in each case merely for a short time out of the position of rest into the second switch position. The quantity injected into a cylinder depends on the pressure level in the delivery line 14 and on the time when a valve 20 is switched. The servo-valves 21 remain in their position of rest during the normal drive operation.

In brake operation, the servo-valves remain in position of rest and the servo-valves 21 are again actuated one after the other. In this way, the actuating elements 14 are acted on by pressure so that they open the decompression valves 25. The magnets 32 are in this connection controlled in the manner that the opening of a decompression valve takes place in each case at the end of the compression stroke of a cylinder in the region of the upper dead center of the piston 38. By displacement of the pressure-limiting valve 35, a pressure level in the delivery line 14 which is high during the injection operation can, on the one hand, be lowered from, for instance, 1000 bar to a low-pressure level of, for instance, 100 bar for the brake operation. On the other hand, the brake pressure level can also still be changed in order to vary the braking action of the engine, or the delivery line 14 can also be relieved completely to the return line 28.

If neither gas is given nor braking effected, the vehicle travels in push operation in which, insofar as not disengaged, aside from the rolling and air resistance, the normal brake action of the internal combustion engine is active. The control of the servo-valves can now be developed in such a manner that, in push operation, neither the servo-valves 20 nor the servo-valves 21 are actuated. On the other hand, the delivery line 14 can, in push operation, also be relieved via the valve 35 to such an extent that actuation of a servo-valve 20 or 21 remains without effect on the corresponding injection nozzle 37 or the corresponding actuating element 24.

Figure 2:
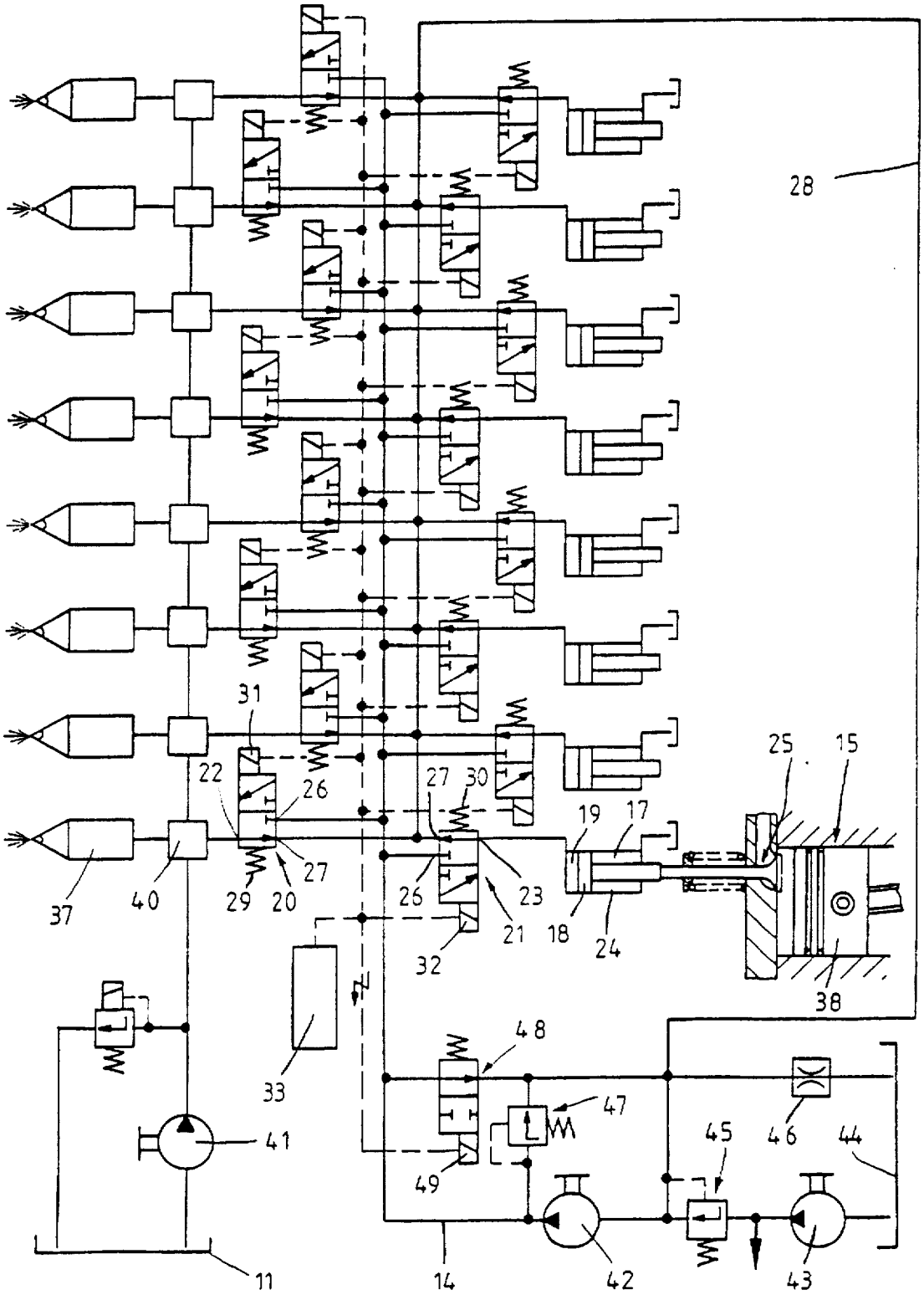
FIG. 2 shows a second embodiment in which there are also present two pulse-actuated servo-valves per cylinder of an internal combustion engine and in which a pressure booster is arranged between an injection nozzle and a servo-valve which control this injection nozzle.

In the embodiment shown in FIG. 2, a pressure booster 40 is inserted between the servo-valves 20 which correspond to the servo-valves 20 of FIG. 1, and therefore have an outlet 22, an inlet 26, an outlet 27, a compression spring 29 and an electromagnet 31, and the injection nozzle 37. Here, therefore, each injection nozzle 37 and a pressure booster 40 form an injection unit, while in the embodiment in accordance with FIG. 1, the injection nozzle alone is the injection unit. Furthermore, in the embodiment according to FIG. 2, a fuel low-pressure pump 41 draws fuel directly from a tank 11 and conveys it to the secondary side of the pressure booster 40. The primary side of the pressure booster 40 is connected with the outlet 22 of the associated servo-valve 20. The servo-valves 21, via which the actuating elements 24 for the decompression valves 25 can be acted on by pressure, correspond to the servo-valves 21 of FIG. 1 and accordingly have an outlet 23, an inlet 26, an outlet 27, a compression spring 30, and an electromagnet 32.

A hydraulic pump 42, which is present in addition to the fuel pump 41 feeds via a delivery outlet 13 into the common delivery line 14 with which the inlets 36 of the servo-valves 20 and 21 are connected, the pump's inlet being connected to the delivery outlet of the engine's lubricating oil pump 43 which draws lubricating oil from the lubricating oil pan 44 of the internal combustion engine. Between the lubricating oil pump 43 and the hydraulic pump 42 there is a pressure-reduction valve 45 by which the pressure at the inlet of the pump 42 is maintained constant. Between the pressure-reduction valve and the lubricating oil pump 43, the lubricating oil circuit for the internal combustion engine is connected. The return line 28 with which the outlets 27 of the servo-valves 20 and 21 are connected debouches into the connection between the pressure-reduction valve 45 and the hydraulic pump 42. Via a nozzle 46, lubricating oil flows also back from the return line 28 to the pan 44 in order to remove heat. By a pressure-limiting valve 47, which is switched between the delivery line 14 and the return line 28, the pressure in the delivery line 14 is limited to a maximum value. Finally, there is also provided a 2/2 directional control valve 48 which can be brought by an electromagnet 49 out of a position of rest, in which it connects the delivery line 14 to the return line 28, into a blocking position. By the directional control valve 48, the delivery line 14 can be completely relieved towards the return line 28 when given values of the parameters of the internal combustion engine are present. One such a case can, for instance, be push operation, in which the braking action of the internal combustion engine is sufficient even without exhaust-brake connected. In normal drive operation and in brake operation, on the other hand, the directional control valve 48 is in its blocking position.

The embodiment in accordance with FIG. 2 operates, in principle, in precisely the same manner as that of FIG. 1. In normal drive operation, the servo-valves 20 in each case one after the other, open the connection between the outlet 22 and the inlet 26, so that the primary side of the pressure booster 40 is acted on by the pressure from the delivery line 14. In this way, the fuel present on the secondary side of a pressure booster 40 is injected under high pressure through the injection nozzle 37 into the operating space of a cylinder 15. In brake operation, the actuating elements 34 are acted on with pressure by the switching of the servo- valves 21 so that the decompression valves 25 of the various cylinders open.

In push operation, in which the delivery line 14 is completely relieved, the servo-valves 20 and/or 21 could, to be sure, be actuated without effect for the injection units 37, 40 or the actuating elements 24. However, it appears advantageous not to actuate any of the servo-valves 20 or 21 also when the delivery line 14 is relieved in push operation.

Figure 3:
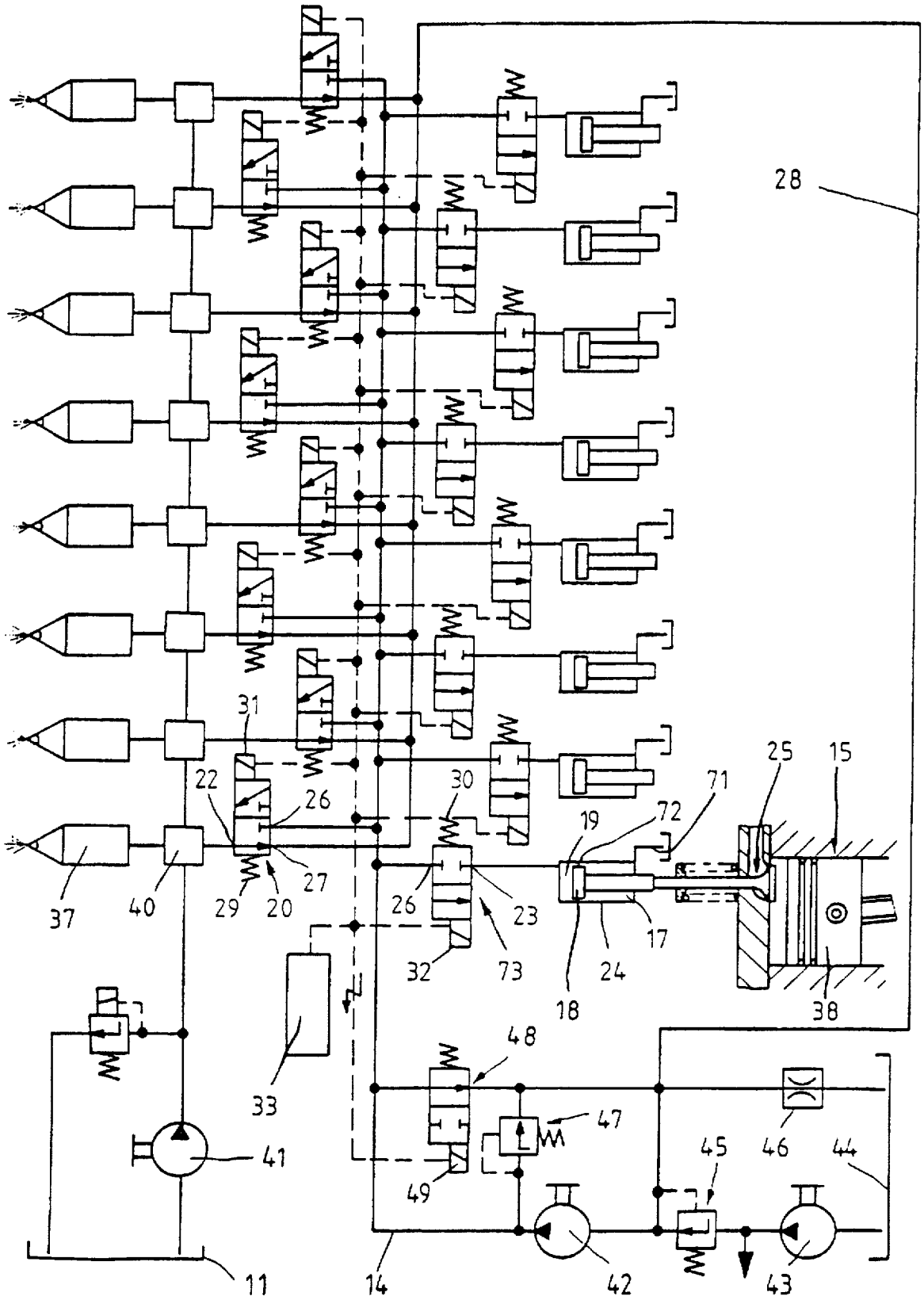
FIG. 3 shows a third embodiment in which the actuating elements for the decompression valves are each relieved via a throttle, and FIGS. 4A, 4B taken together shows a fourth embodiment in which only one pulsewise-actuated servo-valve and one selection valve are present per cylinder of the internal combustion engine.

The embodiment in accordance with FIG. 3 differs from the embodiment of FIG. 2 only with respect to the directional control valves connecting the actuating elements 24 to the delivery line 14 and with respect to the pressure relief of the actuating elements.

Also in the case of the embodiment of FIG. 3, an annular space 17 of an actuating element 24 which lies opposite the pressure space 19 with respect to the piston 18, is connected, via a leakage line 71, to a tank, in the present case, to the lubricating oil pan 44. The diameter of the piston 18 is slightly smaller than the diameter of the cylindrical receiving space within which the piston is located, so that there is an annular slot at throttle 72 between the piston and the receiving space.

The distribution valve which connects the pressure space 19 of an actuating element 24 with the delivery line 14 and blocks in the direction towards the delivery line is a two-position directional control valve 73 which has only the inlet 26, which is connected with the delivery line 14, and the outlet 23, which is connected with the pressure space 19.

In the switch positions of the directional control valves 73 shown in FIG. 3, the pressure spaces 19 of the actuating elements 24 are blocked towards the delivery line 14. The pressure spaces 19 are relieved via the annular slot 72 towards the leakage line 71. If a directional control valve 73 is now switched by an electromagnet 32, the pressure space 19 of the corresponding actuating element 24 is connected with the delivery line 14. Due to the throttling action of the annular slot 72, pressure is therefore built up in the pressure space 19o The corresponding decompression valve 25 is opened. If the directional control valve 73 returns to its starting position, the pressure in the pressure space 19 is decreased via the annular slot 72. The decompression valve 25 closes again.

Figure 5:
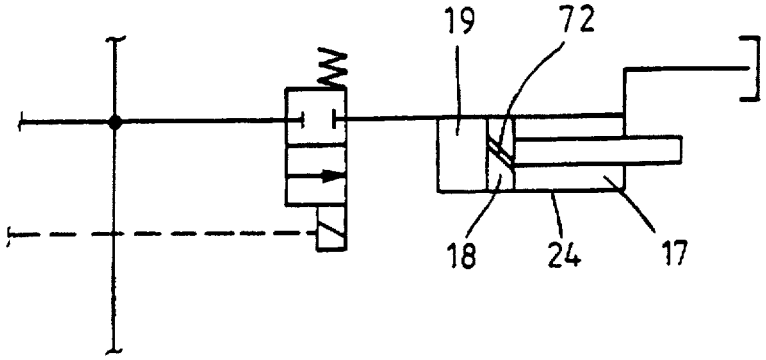
FIG. 5 shows a fifth embodiment, similar to that of FIG. 3, but with a different relief throttle.

In the embodiment of FIG. 5, a throttled connection is also present between the pressure space 19 and the annular space 17 over the piston 18 of the actuating elements 24. In this case, the diameter of a piston 18 is close to the diameter of the cylindrical receiving space for the piston. A throttle 72 between the pressure space 19 and the annular space 17 is formed by a spiral groove on the outer periphery of the piston 18.

Figure 6:
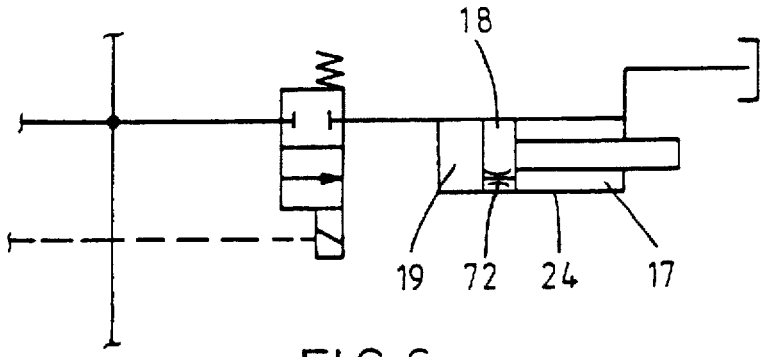
FIG. 6 shows a sixth embodiment, again similar to the embodiment of FIG. 3 but with a further different relief throttle.

In the embodiment of FIG. 6, a throttle 72 is formed between the pressure space 19 and the annular space 17 of an actuating element 24 by an axial groove on the outer periphery of the piston 18 or by an axial borehole through the piston 18.

Figure 7:
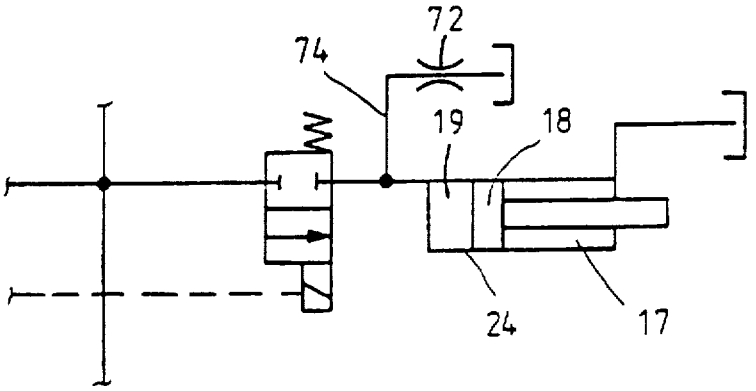
FIG. 7 shows a seventh embodiment, again similar to the embodiment of FIG. 3 but with a further different relief throttle.

In the embodiment of FIG. 7, finally, a throttle 72 for the relief of the pressure space 19 of an actuating element is located outside the receiving space for the piston 18 in a separate leakage line 74.

Figure 4A:
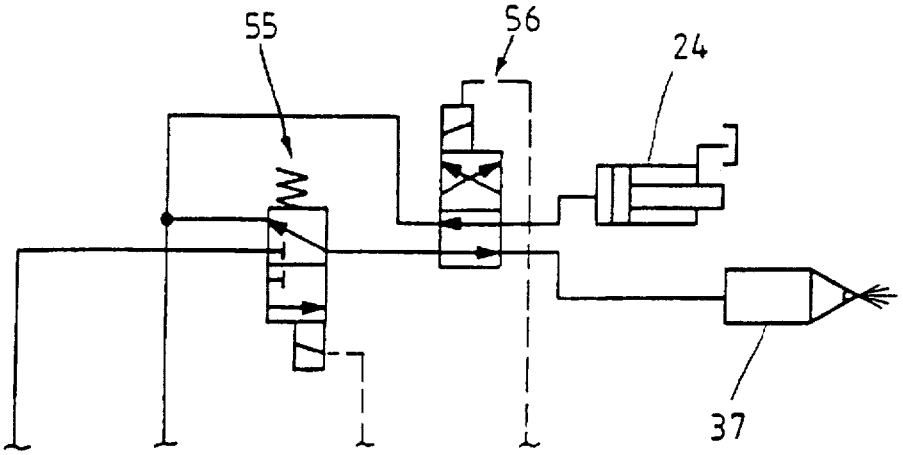
Figure 4B:
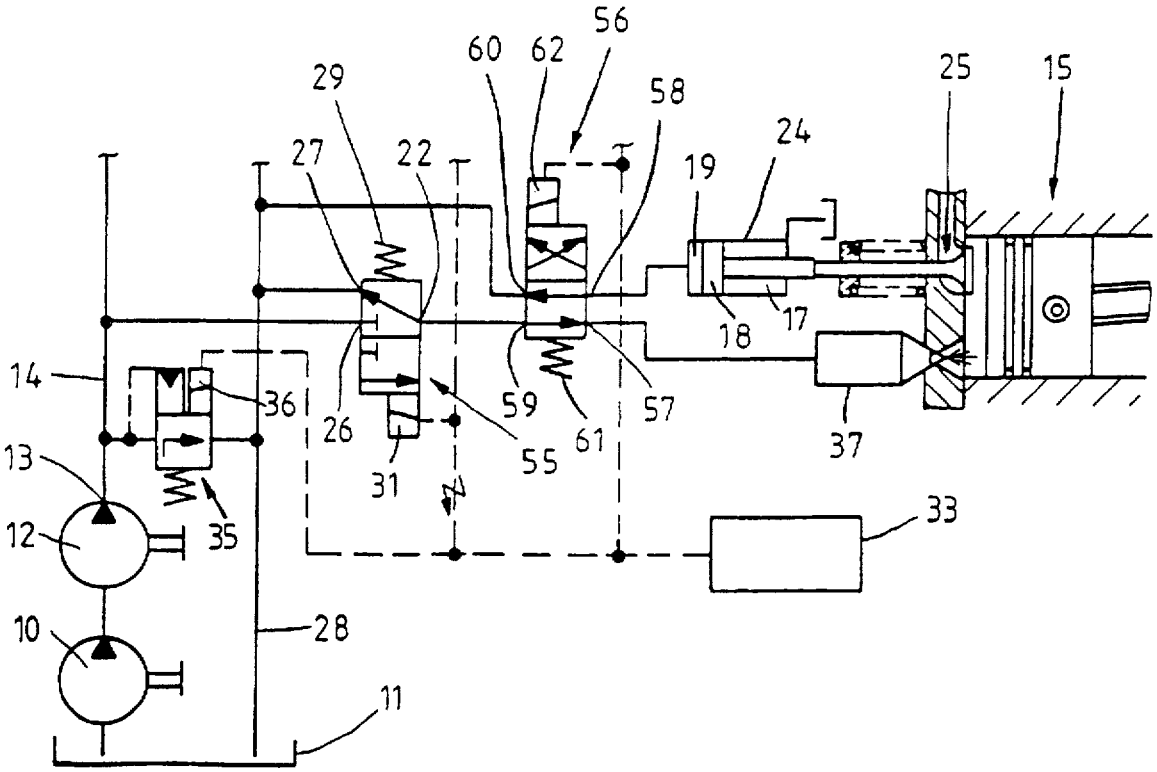

The embodiment of FIGS. 4A, 4B is similar to that of FIG. 1 insofar as, in that case, a high-pressure pump 12 also conveys diesel fuel via a predelivery pump 10 from a tank 11 and discharges it at its delivery outlet 13 into a delivery line 14. Fuel from this delivery line 14 can be injected by an injection nozzle 37 into the cylinders 15 of an internal combustion engine. Furthermore, actuating elements 24 for decompression valves 25 can be acted on with pressure from the delivery line 14. Injection nozzles 37 and actuating elements 24 can furthermore be relieved from pressure to a return line 28.

Differently than in the embodiment of FIG. 1, for the control of the injection nozzle 37 and the actuating of an actuating element 24 of a cylinder 15, instead of two servo-valves actuated with a frequency which is dependent on the speed of rotation of the internal combustion engine, there is used only one such servo-valve, it bearing the reference numeral 55, and a so-called selection valve 56 which, in normal drive operation, assumes a first switch position and, in brake operation, a second switch position and retains this switch position until there is a change in the mode of operation. The selection valve has four outlets, of which a first outlet is connected with the injection nozzle 37, a second outlet 38 with the actuating element 24, a third outlet 59 with an outlet 22 of the servo-valve 55, and a fourth outlet 60 directly with the return line 28. Like the servo-valves 20 and 21 of FIGS. 1 and 2, the servo-valves 55 of the embodiment of FIGS. 4A, 4B also have an inlet 26 which is connected the delivery line 14 and an outlet 27 which is connected with the return line 29. In the position of rest of a servo-valve 55 which is produced by a spring 29, the outlet 22 of said valve is connected via the outlet 27 with the return line 28. After an actuation of a servo-valve 25 by means of an electromagnet 31, the outlet 22 is connected via the inlet 26 with the pressure line 14.

In the first switch position, which the selection valve 56 assumes under the action of a compression spring 61, the outlets 57 and 59 on the one hand and the outlets 58 and 60 on the other hand are connected to each other. By means of an electromagnet 62, a selection valve 56 can be brought into the second switch position, in which the outlets 57 and 60 on the one hand and the outlets 58 and 59 on the other hand are connected with each other.

In precisely the same manner as in the case of the embodiment of FIG. 1, there is present also, in the embodiment of FIGS. 4A, 4B a pressure-limiting valve 35 which can be set at different values by an electromagnet 36. The electromagnets of the different valves are controlled by an electronic unit 33. The electrical wires from the electronic unit 33 to the different electromagnets are indicated by dashed lines.

In accordance with FIG. 4A, 4B all servo-valves 55 and the selection valves 56 are in their position of rest. The actuating elements 24 are relieved directly to the return line 28 via the selection valves 56 and the injection nozzles are relieved to it via the selection valves 56 and the servo-valves 55. The internal combustion engine is turned off or operates in push operation.

In normal drive operation, the injection nozzles 37 must be acted on pulsewise by pressure in accordance with the firing order of the internal combustion engine. For this purpose, the selection valves 56 retain their position of rest, while the servo-valves 55 switch pulsewise and, in this connection, in each case connect the injection nozzles 37 for a short time with the delivery line 14.

In brake operation, the injection nozzles 37 are relieved to the return line 28, and the actuating elements 24 are acted on pulsewise by pressure. For this, the electromagnets 62 bring the selection valves 56 into the other switch position, in which the injection nozzles 37 are connected via the switch valves 56 directly with the return line 28, and the actuating elements 24 can be connected pulsewise with the delivery line 14 via the servo-valves 54 and, in between, can be relieved to the return line 28. In the present example, the injection nozzles 37 can be acted on by pressure in the position of rest of the selection valves 56, since it is assumed that the total duration of the normal drive operation is longer than the total duration of the brake operation, so that the electromagnets 62 must be energized for a shorter total period of time than in the case of the reverse arrangement of spring 61 and magnets 62.

The controlling of the actuating elements 24 by individually actuatable servo-valves affords the possibility of varying the braking action of the exhaust-brake with the same pressure in the delivery line 14 also in the manner that, in braking operation, there are controlled only a number of servo-valves which is smaller than the total number of cylinders present in the internal combustion engine. Then, only the decompression values present on the corresponding cylinders are opened.

The use of individually actuatable servo-valves for the actuating elements 24 furthermore affords the possibility of providing, in the partial-load region of the internal combustion engine, fuel only to a number of cylinders which is less than the total number of cylinders via the injection valve and keeping the decompression valves continuously open on the other cylinders by a continuous actuation of the corresponding servo-valves. The cylinders which are not supplied with fuel then develop neither the normal braking action of push operation nor the braking action of the exhaust-brake. The operation of the internal combustion engine is then particularly favorable from an energy standpoint.

It is obvious that the last two methods of operation indicated are advantageous even if injection and exhaust-brake are realized by two subsystems on the internal combustion engine which are entirely separate from each other and are supplied with pressure fluid separately from each other.

We claim:

1. An injection and exhaust-brake system for an internal combustion engine having a plurality of cylinders, in particular for a diesel engine, having a hydraulic pump with a delivery outlet to which a delivery line which is common to the cylinders is connected, having a plurality of injection units, each of which is associated with a different one of said cylinders and, in normal drive operation, can be controlled pulsewise by connection with the delivery line, and having several decompression valves each of which is associated with another cylinder and, in brake operation, aside from the exhaust stroke and particularly at the end of the compression stroke, can be controlled pulsewise by varying pressure action on and pressure relief of a hydraulic actuating element, further comprising a plurality of valve arrangements each of which is associated with a different cylinder and, in normal drive operation, connects the injection unit and, in the brake operation, the hydraulic actuating element on the corresponding cylinder, with proper timing, to the delivery line, wherein; an injection unit comprises an injection nozzle and a pressure booster arranged upstream of the injection nozzle; a fuel pump by which fuel can be conveyed to a secondary side of the pressure booster; and via servo-valves, a primary side of the pressure booster can be acted on by pressure in the normal drive operation and the actuating elements can be acted on by pressure in the brake operation.

2. An injection and exhaust-brake system according to claim 1, wherein that a valve arrangement comprises a first servo-valve which has an injection-unit-side outlet which, in a first valve position, is separated from the delivery line and, in a second valve position, is connected with the delivery line and can be controlled pulsewise in normal drive operation, and a second servo-valve which has an actuating-element-side outlet which in a first position is separated from the delivery line and in a second valve position is connected with the delivery line and which is controllable pulsewise in the brake operation.

3. An injection and exhaust-brake system according to claim 2, wherein the first servo-valve and the second servo-valve, which are associated with the same cylinder, are two separate directional control valves with separate, individually actuatable control members.

4. An injection and exhaust-brake system according to claim 2, wherein a servo-valve can, under the action of a spring element, assume a position in which an injection-unit-side or actuating-element-side outlet of the servo-valve is separated from the delivery line.

5. An injection and exhaust-brake system according to claim 2, wherein a pressure space of a hydraulic actuating element can be connected, in the brake operation, via connections of a valve arrangement, with proper timing, alternately to the delivery line and a relief line.

6. An injection and exhaust-brake system according to claim 2, wherein a pressure space (19) of a hydraulic actuating element (24) is continuously connected to a throttle (72) which is arranged between the pressure space (19) and a relief line (71); and the pressure space (19) can be connected, via the valve arrangement (20, 73), with proper timing, to the delivery line (14).

7. An injection and exhaust-brake system according to claim 1, wherein a pressure space of a hydraulic actuating element can be connected, in the brake operation, via connections of a valve arrangement, with proper timing, alternately with the delivery line and a relief line.

8. An injection and exhaust-brake system according to claim 1, wherein a pressure space (19) of a hydraulic actuating element (24) is continuously connected with a throttle (72) which is arranged between the pressure space (19) and a relief line (71), and the pressure space (19) can be connected, via the valve arrangement (20, 73), with proper timing, to the delivery line (14).

9. An injection and exhaust-brake system according to claim 1, wherein the pressure fluid conveyed by high-pressure pump (12) is fuel, and injection nozzles (37) which are included in the injection units can be connected via servo-valves (20, 55) pulsewise with the delivery line (14).

10. An injection and exhaust-brake system according to claim 1, wherein the delivery line to which the servo-valves are connected is connected to the delivery outlet of the hydraulic pump other than the fuel pump.

11. An injection and exhaust-brake system according to claim 1, further comprising electromagnets, and the valve arrangements are servo-valves which are actuatable by said electromagnets.

* * * * *